US008495843B1

(12) United States Patent
Horneland

(10) Patent No.: US 8,495,843 B1
(45) Date of Patent: Jul. 30, 2013

(54) BUCK SYSTEM

(76) Inventor: Knut Horneland, Tampa, FL (US)

( * ) Notice: Subject to any disclaimer, the term of this patent is extended or adjusted under 35 U.S.C. 154(b) by 0 days.

(21) Appl. No.: 13/451,614

(22) Filed: Apr. 20, 2012

(51) Int. Cl.
*E06B 1/56* (2006.01)
*E04B 2/16* (2006.01)

(52) U.S. Cl.
USPC ..... 52/215; 52/309.12; 52/745.15

(58) Field of Classification Search
USPC ..... 52/215, 425–427, 481.2, 656.2, 656.5, 52/656.6, 309.12, 745.15
See application file for complete search history.

(56) References Cited

U.S. PATENT DOCUMENTS

| | | | | | |
|---|---|---|---|---|---|
| 2,718,291 | A * | 9/1955 | Goldberg | 49/504 |
| 2,766,855 | A * | 10/1956 | Johnson et al. | 52/126.3 |
| 3,339,324 | A * | 9/1967 | Stackhouse | 52/241 |
| 3,886,688 | A * | 6/1975 | Ragland | 49/504 |
| 3,924,373 | A * | 12/1975 | Lizdas et al. | 52/213 |
| 4,016,690 | A * | 4/1977 | Richardson | 52/238.1 |
| 4,223,494 | A * | 9/1980 | Wendt | 52/211 |
| 4,281,481 | A * | 8/1981 | Wendt | 49/504 |
| 4,443,984 | A * | 4/1984 | Rasmussen | 52/213 |
| 4,614,068 | A * | 9/1986 | Bergthold | 52/211 |
| 5,319,884 | A * | 6/1994 | Bergeron | 49/504 |
| 5,791,103 | A | 8/1998 | Coolman et al. | |
| 5,896,714 | A | 4/1999 | Cymbala et al. | |
| 5,996,293 | A | 12/1999 | Anderson et al. | |
| 6,070,375 | A | 6/2000 | Anderson et al. | |
| 6,530,185 | B1 | 3/2003 | Scott et al. | |
| 7,340,866 | B1 * | 3/2008 | Smith | 52/204.54 |
| 8,407,954 | B2 * | 4/2013 | Keith et al. | 52/213 |
| 2009/0193729 | A1 | 8/2009 | Kustermann | |
| 2012/0137606 | A1 * | 6/2012 | Mees | 52/204.1 |
| 2012/0216478 | A1 * | 8/2012 | Mees | 52/426 |

* cited by examiner

*Primary Examiner* — Robert Canfield
(74) *Attorney, Agent, or Firm* — Larson & Larson, P.A.; Frank Liebenow; Justin P. Miller

(57) ABSTRACT

A buck system for forming and framing an opening in a poured concrete foundation includes a plurality of buck sections matching the desired dimension of an opening. Each of the buck sections is affixed to an adjacent buck section forming a closed geometric shape. Each buck section has an inner surface defining an inside dimension of the opening and each of the buck sections has a first channel and a second channel. The first channel snuggly accepts an edge of a first insulated concrete foundation wall of the insulated concrete foundation walls and the second channel snuggly accepts an edge of a second insulated concrete foundation wall of the insulated concrete foundation walls.

7 Claims, 3 Drawing Sheets

BUCK SYSTEM

CROSS-REFERENCE TO RELATED PATENTS

For reference and understanding of Insulated Concrete Forms (ICF), U.S. Pat. No. 5,896,714 to Cymbala, et al, issued Apr. 27, 1999, describes an exemplary insulated concrete forming system and is hereby incorporated by reference.

FIELD

This invention relates to bucks used for forming an opening in a wall and more particularly to a buck system for forming an opening in a poured concrete wall in which the concrete is held by Insulated Concrete Forms.

BACKGROUND

Most windows and other openings in buildings include frames (e.g. window frames) and inserts (e.g. window glass panels, doors, etc.). For framed construction, rough framing is constructed before the frames (window frame, door frame) are installed and the rough framing is constructed sufficiently to support structures above the opening by extra studs and headers, etc.

For poured concrete installations, generally the frame is not strong enough to withstand the weight of the poured concrete. Furthermore, the typical frame does not provide sufficient rigidity for the openings after the building is completed, the walls are formed around the window opening, and the concrete dries.

To solve this problem, a rigidifying box or outer-frame called a "buck" is typically formed or built to provide a receptacle or opening into which the frames can be mounted after the concrete is poured.

In Modern construction techniques, the walls of portions or of the entire building are formed by pouring concrete into forms or molds. This method has long been done in the fabrication of basement walls, either created on-site or off-site in which an entire wall is pre-fabricated then positioned into a vertical position and installed on-site.

Bucks for use with poured concrete walls have been disclosed in the prior art. For example, U.S. Pat. No. 5,996,293 to Anderson, et al, describes a buck system made by extruding vinyl. Bucks of any useful dimension that are made according to this disclosure are not sturdy enough to withstand the force of wet, poured concrete and, therefore, require many braces to prevent sagging and/or collapse after the concrete is poured. Furthermore, the described buck system does not adequately accommodate Insulated Concrete Forms (ICF), which have become very popular in the construction industry.

In another example, U.S. Pat. No. 6,070,375 to Anderson, et al, describes a buck system made by extruding vinyl. Again, Bucks of any useful dimension that are made according to disclosure are not sturdy enough to withstand the force of wet, poured concrete and, therefore, require many braces to prevent sagging and/or collapse after the concrete is poured.

In another example, U.S. Pat. No. 6,530,185 to Scott, et al, describes a buck system for Insulated Concrete Forms that is made of plastic. Again, Bucks of any useful dimension that are made according to the disclosed system are not sturdy enough to withstand the force of wet, poured concrete and, therefore, require many braces to prevent sagging and/or collapse after the concrete is poured.

In all of the above examples, the overall construction, materials and design does not provide added structure to the ICF and, for all useful sizes of frames, requires substantial bracing and squaring (corner angles).

What is needed is a buck system that will support the force and weight of concrete with no or minimal bracing and will provide a sturdy base for frames.

SUMMARY

In one embodiment, a buck system for forming and framing an opening in a poured concrete foundation is disclosed. The foundation being poured between two insulated concrete foundation walls. The buck system includes a plurality of buck sections matching the desired dimension of the opening. Each of the buck sections is affixed to an adjacent buck section forming a closed geometric shape. Each buck section has an inner surface defining an inside dimension of the opening and each of the buck sections has a first channel and a second channel. The first channel snuggly accepts an edge of a first insulated concrete foundation wall of the insulated concrete foundation walls and the second channel snuggly accepts an edge of a second insulated concrete foundation wall of the insulated concrete foundation walls.

In another embodiment, a method of making a framed opening in a poured concrete foundation is disclosed. The foundation being poured between two insulated concrete foundation walls. The method including forming a plurality of buck sections to match the desired dimension of the opening and affixing each of the plurality of buck sections to an adjacent buck section of the plurality of buck sections forming a closed geometric shape. Each buck section has an inner surface defining an inside dimension of the opening and each of the buck sections has a first channel and a second channel. The method continues with positioning edges of a first insulated concrete foundation wall of the insulated concrete foundation walls into the first channel and positioning edges of a second insulated concrete foundation wall of the insulated concrete foundation walls into the second channel then pouring concrete between the first insulated concrete wall and the second insulated concrete wall.

In another embodiment, a buck system for forming and framing an opening in a poured concrete foundation is disclosed. The foundation being poured between two insulated concrete foundation walls. The buck system includes a plurality of buck sections matching the desired dimension of the opening. Each of the buck sections is affixed to an adjacent buck section forming a closed geometric shape. Each buck section has an inner surface defining an inside dimension of the opening and each of the buck sections has a first channel and a second channel. The first channel snuggly accepts an edge of a first insulated concrete foundation wall of the insulated concrete foundation walls and the second channel snuggly accepts an edge of a second insulated concrete foundation wall of the insulated concrete foundation walls. Each of the plurality of buck sections comprises an outer U-shaped member, an inner U-shaped member, and a hat. The inner surface is formed by an outer surface of the hat, the first channel is formed between a first inner surface of the outer U-shaped member and a first outer surface of the inner U-shaped member, and the second channel is formed between a second inner surface of the outer U-shaped member and a second outer surface of the inner U-shaped member.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1A:
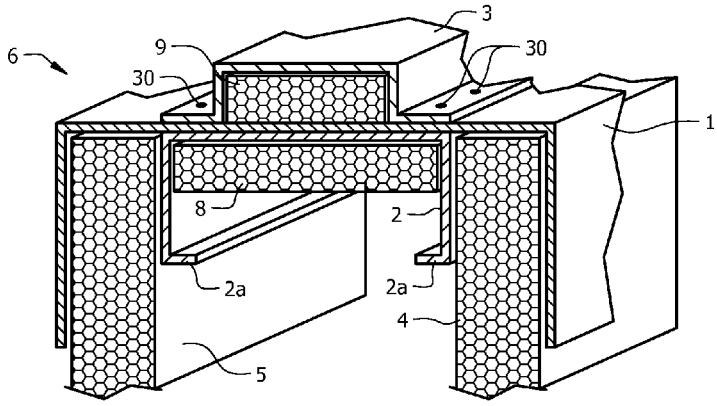
FIG. 1A illustrates a cross-sectional view of a first example of a section of the buck system.

Reference will now be made in detail to the presently preferred embodiments of the invention, examples of which are illustrated in the accompanying drawings. Throughout the following detailed description, the same reference numerals refer to the same elements in all figures.

Throughout the description, the terms "insulated concrete foundation" and "insulated concrete foundation wall" refer the well-known system of fabrication of concrete walls, not necessarily limited to foundation walls, but to any concrete wall of a structure, including interior walls and higher story walls, etc.

The disclosed buck system provides an anchoring base for windows and doors that will provide extreme resistance to fenestration failures with wind damage situations such as hurricanes. The disclosed buck system provides the proper pull out strength required in the various wind/hurricane zone areas often required by building and life safety codes.

Figure 1B:
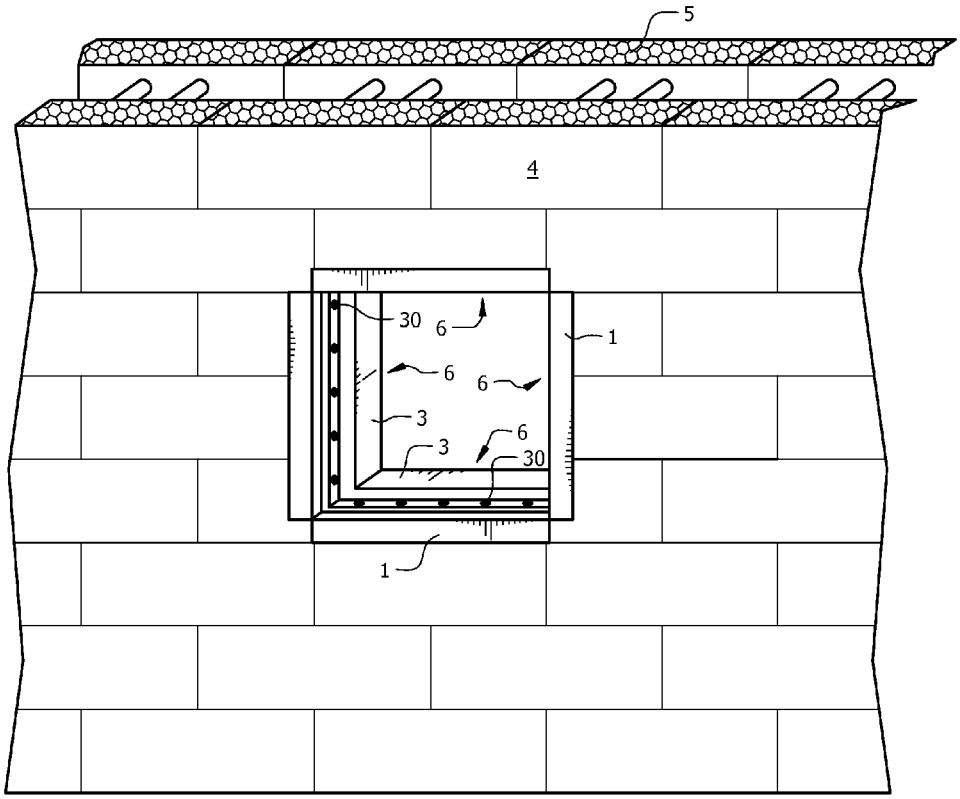
FIG. 1B illustrates a perspective view of the first example of the buck system installed as a window rough frame in an insulated concrete foundation.

Referring to FIGS. 1A and 1B, a cross-sectional view of a first example of the buck section 6 is shown. The buck section 6 is shown installed in an insulated concrete foundation 4/5 in FIG. 1B. The buck section 6 in this example includes three components: an outer U-shaped member 1, an inner U-shaped member 2 with bent edges 2*a* and a hat member 3.

The space between the inside of the side edges of the outer U-shaped member 1 and the outside of the side edges of the inner U-shaped member 2 form channels for receiving the edges of the insulated concrete foundation walls. The insulated concrete foundation walls 4/5 fit between snuggly in these channels between the inside of the side edges of the outer U-shaped member 1 and the outside of the side edges of the inner U-shaped member 2.

The hat is part of and/or affixed to the outside of the base of the outer u-shaped member 1. The components 1/2/3 of the buck section 6 are made of a sturdy material including, but not limited to, steel, iron, polyvinylchloride (PVC), etc., although steel is preferred. It is preferred to use a structurally strong material such as steel to eliminate and/or greatly reduce the need for bracing while concrete is poured into the gap between the insulated concrete foundation walls 4/5. In this, the buck sections 6 receive fluid pressure from the concrete (until the concrete sets) as well as pressure from the weight of the concrete. The buck section 6 is self-supporting for openings of up to approximately 3.5 feet when the components 1/2/3 are made of, for example, 20 gauge steel. For wider spans, it is anticipated that the components 1/2/3 are made from a heavier gauge steel such as 16 gauge steel and/or minimal bracing is provided during pouring of the concrete and until the concrete sets.

The components 1/2/3 are formed as one piece or held together such as with fasteners 30 (screws are shown). When screws are used as fasteners 30, it is anticipated that the screws are spaced at 8" distances, though any spacing is anticipated.

To create the desired rough frame, a number of sections of the buck section 6 are provided/cut to the desired dimensions and the sections are then fastened to each other by, for example, clips. The example shown in FIG. 1B has four sections of the buck system 6 and four clips (not shown) holding the corners of the sections of the buck system 6 together. Note that, although a rectangular rough frame is shown in FIG. 1B, any shape rough frame is anticipated (e.g., hexagonal, octagonal, etc).

The hat member 3 typically interfaces with the window frame, door frame, etc. When the frame is installed into the rough frame constructed from multiple sections of the buck section 6, fasteners are typically set through the frame and into the buck section 6, in particular, the hat 3 of the buck section 6.

In some embodiments, some or the entire gap between the inner sides of the hat 3 and the outer side surface of the outer u-shaped member 1 is filled with a soft material 9 such as Styrofoam® (closed-cell extruded polystyrene foam). This serves at least two purposes. The soft material 9 reduces flow of concrete into this gap and provides some amount of insulation. It is desired to prevent/reduce flow of concrete into this gap so that, after the concrete is poured and sets, fasteners (e.g. nails, screws, etc. not shown) are not blocked 20 by hardened concrete (e.g. when the frame is installed into the rough frame).

In some embodiments, the base of the inner u-shaped member 2 is lined with a section of a soft material 8 such as Styrofoam® (closed-cell extruded polystyrene foam), again providing some amount of insulation between the concrete and the buck section 6, but also preventing/reducing flow of concrete into this gap so that, after the concrete is poured 5 and sets, fasteners (e.g. nails, screws, etc.) are not blocked by hardened concrete.

Figure 2A:
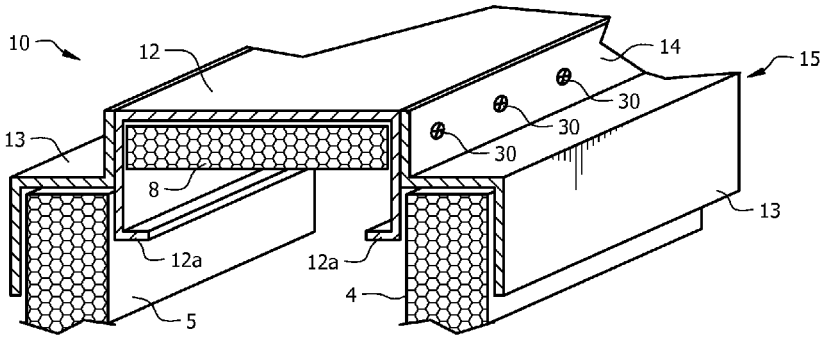
FIG. 2A illustrates a cross-sectional view of a second example of a section of the buck system.
Figure 2B:
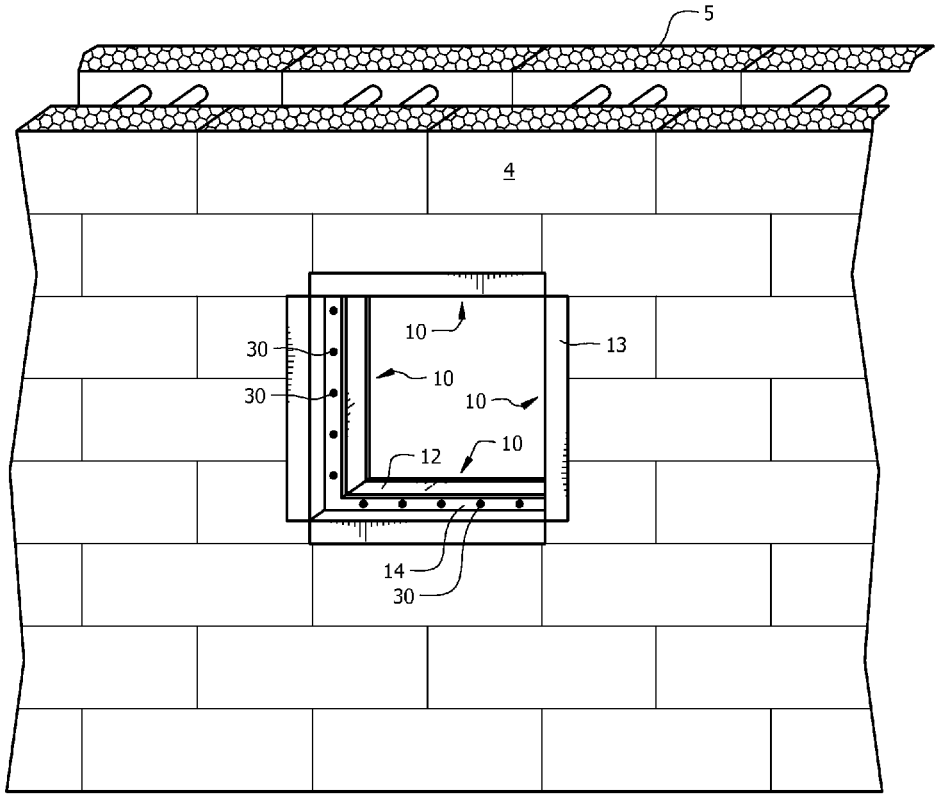
FIG. 2B illustrates a perspective view of the second example of the buck system installed as a window rough frame in an insulated concrete foundation.

Referring to FIGS. 2A and 2B, a cross-sectional view of a second example of the buck section 10 is shown. The buck section 10 is shown installed in an insulated concrete foundation 4/5 in FIG. 2B. The buck section 10 in this example includes three components: two outer Z-shaped members 15 and an inner U-shaped member 12 with bent edges 12*a*.

The space between the inside of the side edges 13 of the Z-shaped member 15 and the outside of the side edges of the inner U-shaped member 12 form channels for receiving the edges of the insulated concrete foundation walls. The insulated concrete foundation wall edges 4/5 fit between snuggly within these channels between the inside of the side edges 13 of the Z-shaped member 15 and the outside of the side edges of the inner U-shaped member 12.

Each of the Z-shaped members are part of and/or affixed to outer surfaces of the side edges of the inner U-shaped member, for example using screws. The components 12/15 of the buck section 10 are made of a sturdy material including, but not limited to, steel, iron, polyvinylchloride (PVC), etc., although steel is preferred. It is preferred to use a structurally strong material such as steel to eliminate and/or greatly reduce the need for bracing while concrete is poured into the gap between the insulated concrete foundation walls 4/5. In this, the buck sections 10 receive fluid pressure from the concrete (until the concrete sets) as well as pressure from the weight of the concrete. The buck section 10 is self-supporting for openings of up to approximately 3.5 feet when the components 12/15 are made of, for example, 20 gauge steel. For wider spans, it is anticipated that the components 12/15 are made from a heavier gauge steel such as 16 gauge steel and/or minimal bracing is provided during pouring of the concrete and until the concrete sets.

The components 12/15 are formed as one piece or held together such as with fasteners 30 (screws are shown). When screws are used as fasteners 30, it is anticipated that the screws are spaced at 8" distances, though any spacing is anticipated.

To create the desired rough frame, a number of the buck section 10 are provided/cut to the desired dimensions and the sections are then fastened to each other by, for example, clips. The example shown in FIG. 2B has four buck sections 10 and four clips (not shown) holding the corners of the sections of the buck section 10 together. Note that, although a rectangular rough frame is shown in FIG. 2B, any shape rough frame is anticipated (e.g., hexagonal, octagonal, etc.).

The inner U-shaped member 12 typically interfaces with the window frame, door frame, etc. When the frame is installed into the rough frame constructed from multiple buck sections 10, fasteners are typically set through the frame and into the buck section 10, in particular, the fasteners are set into the outer surface of the base of the U-shaped member 12 of the buck section 10.

In some embodiments, the base of the inner u-shaped member 12 is lined with a section of a soft material 8 such as Styrofoam® (closed-cell extruded polystyrene foam), providing some amount of insulation between the concrete and the buck section 10, but also preventing/reducing flow of concrete into this area against the inner surface of the base of the U-shaped member 12 so that, after the concrete is poured and sets, fasteners (e.g. nails, screws, etc.) are not blocked by 20 hardened concrete.

Figure 3A:
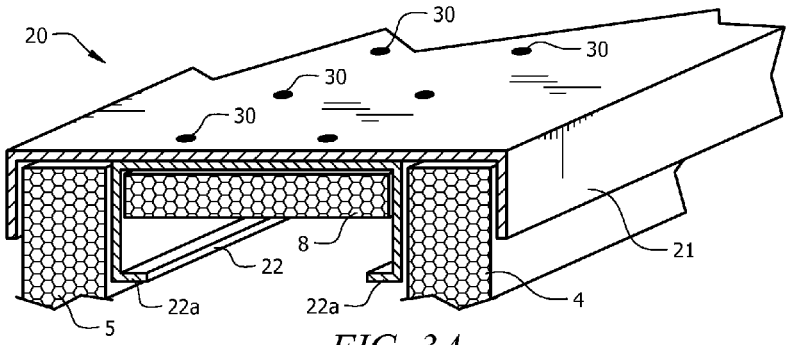
FIG. 3A illustrates a cross-sectional view of a third example of a section of the buck system.
Figure 3B:
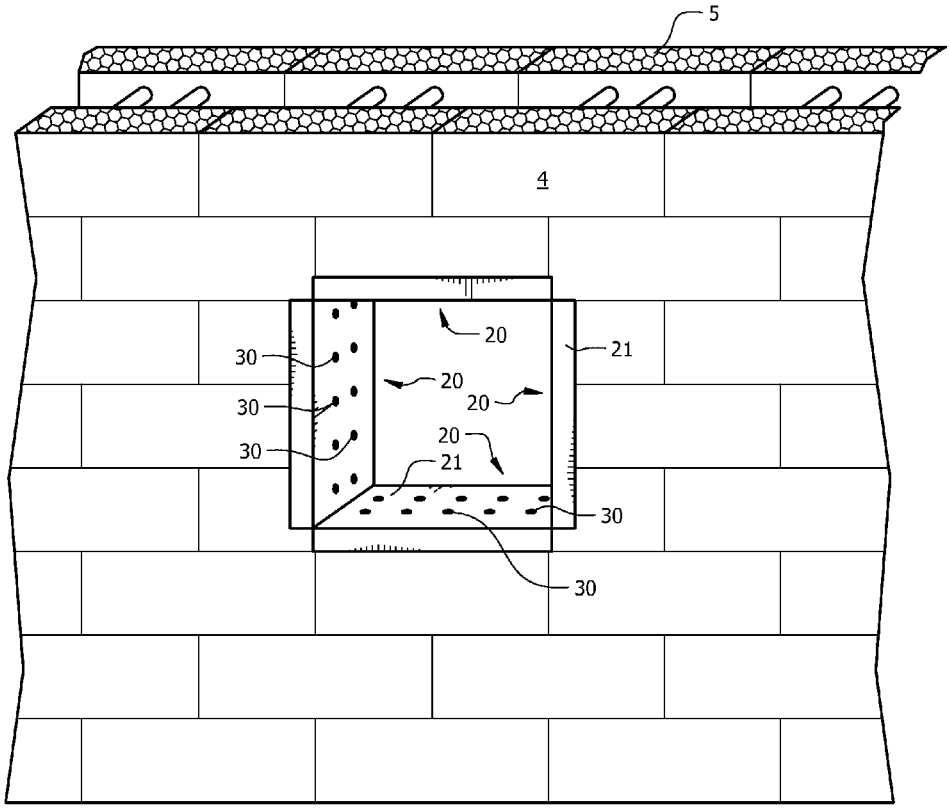
FIG. 3B illustrates a perspective view of the third example of the buck system installed as a window rough frame in an insulated concrete foundation.

Referring to FIGS. 3A and 3B, a cross-sectional view of a first example of the buck section 20 is shown. The buck section 20 is shown installed in an insulated concrete foundation 4/5 in FIG. 3B. The buck section 20 in this example includes two components: an outer U-shaped member 21 and an inner U-shaped member 22 with bent edges 22*a*.

The space between the inside of the side edges of the outer U-shaped member 21 and the outside of the side edges of the inner U-shaped member 22 form channels for receiving the edges of the insulated concrete foundation walls. The edges of the insulated concrete foundation walls 4/5 fit snuggly in these channels between the inside of the side edges of the outer U-shaped member 21 and the outside of the side edges of the inner U-shaped member 22.

The outer U-shaped member is part of and/or affixed to outer top surfaces of the inner U-shaped member 22, for example using screws. The components 21/22 of the buck section 20 are made of a sturdy material including, but not limited to, steel, iron, polyvinylchloride (PVC), etc., although steel is preferred. It is preferred to use a structurally strong material such as steel to eliminate and/or greatly reduce the need for bracing while concrete is poured into the gap between the insulated concrete foundation walls 4/5. In this, the buck sections 20 receive fluid pressure from the concrete (until the concrete sets) as well as pressure from the weight of the concrete above. The buck sections 20 are self-supporting for openings of up to approximately 3.5 feet when the components 21/22 are made of, for example, 20 gauge steel. For wider spans, it is anticipated that the components 21/22 are made from a heavier gauge steel such as 16 gauge steel and/or minimal bracing is provided during pouring of the concrete and until the concrete sets.

The components 21/22 are formed as one piece or held together such as with fasteners 30 (screws are shown). When screws are used as fasteners 30, it is anticipated that the screws are spaced at 8" distances, though any spacing is anticipated.

To create the desired rough frame, a number of buck sections 20 are provided/cut to the desired dimensions and the sections are then fastened to each other by, for example, clips. The example shown in FIG. 3B has four buck sections 20 and four clips (not shown) holding the corners of the buck sections 20 together. Note that, although a rectangular rough frame is shown in FIG. 3B, any shape rough frame is anticipated (e.g., hexagonal, octagonal, etc.).

The inner U-shaped member 22 typically interfaces with the window frame, door frame, etc. When the frame is installed into the rough frame constructed from multiple sections of the buck section 20, fasteners are typically set through the frame in into the buck section 20, in particular, the fasteners are set into the outer surface of the base of the U-shaped member 22 of the buck 20.

In some embodiments, the base of the inner u-shaped member 22 is lined with a section of a soft material 8 such as Styrofoam® (closed-cell extruded polystyrene foam), providing some amount of insulation between the concrete and the buck section 20, but also preventing/reducing flow of concrete into this area against the inner surface of the base of the U-shaped member 22 so that, after the concrete is poured and sets, fasteners (e.g. nails, screws, etc.) are not blocked by hardened concrete.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A buck system for forming and framing an opening in a poured concrete foundation, the foundation poured between two insulated concrete foundation walls, the buck system comprising:

a plurality of buck sections matching the desired dimension of the opening, each of the plurality of buck sections affixed to an adjacent buck section of the plurality of buck sections forming a closed geometric shape, each buck section having an inner surface defining an inside dimension of the opening, and each of the buck sections having a first channel and a second channel, the first channel snuggly accepts an edge of a first insulated concrete foundation wall of the two insulated concrete foundation walls and the second channel snuggly accepts an edge of a second insulated concrete foundation wall of the two insulated concrete foundation walls;

wherein each of the plurality of buck sections comprises an outer U-shaped member, an inner U-shaped member, and a hat, whereas the inner surface is formed by an outer surface of the hat, the first channel is formed between a first inner surface of the outer U-shaped member and a first outer surface of the inner U-shaped member, and the second channel is formed between a second inner surface of the outer U-shaped member and a second outer surface of the inner U-shaped member.

2. The buck system of claim 1, wherein the inner U-shaped member has edges that bend inward.

3. The buck system of claim 1, further comprising an insulative material disposed within the hat.

4. The buck system of claim 1, further comprising an insulative material disposed at an inside base of the inner U-shaped member.

5. A method of making a framed opening in a poured concrete foundation, the foundation poured between two insulated concrete foundation walls, the method comprising:

forming a plurality of buck sections to match the desired dimension of the opening;

affixing each of the plurality of buck sections to an adjacent buck section of the plurality of buck sections forming a closed geometric shape, each buck section having an inner surface defining an inside dimension of the opening, and each of the buck sections having a first channel and a second channel, wherein each of the plurality of buck sections comprises an outer U-shaped member, an inner U-shaped member, and a hat, whereas the inner surface is formed by an outer surface of the hat, the first channel is formed between a first inner surface of the outer U-shaped member and a first outer surface of the inner U-shaped member, and the second channel is formed between a second inner surface of the outer U-shaped member and a second outer surface of the inner U-shaped member;

positioning edges of a first insulated concrete foundation wall of the insulated concrete foundation walls into the first channel;

positioning edges of a second insulated concrete foundation wall of the insulated concrete foundation walls into the second channel; and pouring concrete between the first insulated concrete wall and the second insulated concrete wall.

6. The method of claim 5, wherein the inner U-shaped member has edges that bend inward.

7. The method of claim 5, further comprising an insulative material disposed at an inside base of the inner U-shaped member.

* * * * *